United States Patent [19]

Antonio

[11] Patent Number: 4,767,373

[45] Date of Patent: Aug. 30, 1988

[54] TOY WINDMILL WITH CONVENIENT ASSEMBLY FEATURES

[76] Inventor: Jorge E. Antonio, Estrada Olina Ellis 92, Campo Grande, Rio de Janeiro, Brazil

[21] Appl. No.: 836,669

[22] Filed: Mar. 5, 1986

[30] Foreign Application Priority Data

Sep. 19, 1985 [BR] Brazil ..... 8504587

[51] Int. Cl.[4] ..... A63H 33/40; A63H 33/00

[52] U.S. Cl. ..... 446/217; 446/488

[58] Field of Search ..... 446/217, 218, 488, 465, 446/466, 469, 471; 24/326, 336, 339

[56] References Cited

U.S. PATENT DOCUMENTS

| | | | |
|---|---|---|---|
| 1,268,644 | 6/1918 | Truitt | 446/217 |
| 1,669,748 | 5/1928 | Greger | 446/218 |
| 1,910,923 | 5/1933 | Kerr | 446/218 |
| 2,066,063 | 12/1936 | Walker | 446/217 X |
| 2,510,336 | 6/1950 | Donahue | 446/217 |
| 2,857,507 | 10/1958 | Stec | 446/217 X |
| 3,229,412 | 1/1966 | Golub et al. | 446/217 |
| 3,974,369 | 8/1976 | Chmela et al. | 446/217 |

FOREIGN PATENT DOCUMENTS

| | | | |
|---|---|---|---|
| 902365 | 6/1970 | Canada | 446/217 |
| 0199839 | 11/1986 | European Pat. Off. | 446/218 |
| 926008 | 9/1947 | France | 446/465 |

*Primary Examiner*—Robert A. Hafer
*Assistant Examiner*—D. Neal Muir
*Attorney, Agent, or Firm*—Beveridge, DeGrandi & Weilacher

[57] ABSTRACT

A toy windmill having a special mounting system as described, the windmill being of the type normally comprising one or more sheets of plastic, paper of the like, having an orifice in the center thereof for receiving the windmill shaft. The sheet or sheets define a plurality of blades having free ends which are also provided with orifices. When the windmill is mounted, said blades are doubled over themselves so that the orifices in their ends coincide and the shaft passes therethrough to define the final shape of the windmill. After this, the blade ends are mounted on the shaft by a ring formed by two releasably cooperating engagement portions for retaining the ends of the blades therebetween.

1 Claim, 2 Drawing Sheets

TOY WINDMILL WITH CONVENIENT ASSEMBLY FEATURES

The present invention refers to toy windmills and more particularly to a system for mounting a toy windmill.

Toy windmills normally consist of one or more sheets of plastic, paper or the like, cut to define a plurality of blades at free ends, and a central orifice in said sheet or sheets, through which a pin or shaft is passed when the windmill is mounted. Orifices are also provided at the ends of each blade so that they may be folded over themselves, and that the shaft may pass through such orifices at the ends of the blades, after which fixing means are used to hold the ends of the blades together. Such fixing means normally comprises a metal eyelet which is applied by means of a special tool, said shaft or pin extending through said eyelet, so as to provide the windmill with its final configuration.

Such known mounting system, however, have one serious disadvantage relating to transport and storage of the windmills in large quantities, since, once mounted, they cannot be dismounted, since the eyelet is fixed under pressure, usually by a suitable tool which deforms the eyelet (generally a metal) making the mounting permanent. The shop-keeper who wishes to maintain a stock in his shop for example, then has to face the serious problem of the mounted toy windmills occupying a considerable amount of storage space. Furthermore, the manufacturer cannot leave it to the shop-keeper or buyer to mount the product since it not only requires considerable dexterity but also a suitable tool.

The object of the present invention is, therefore, to overcome the above disadvantages of the prior art.

This object is obtained in the present invention by providing a toy windmill of the above type, in which the means for fixing the ends of the blades together around the pin or shaft consists of a ring formed by two releasably cooperating engagement portions for holding the ends of the blades therebetween.

Preferably the two engagement portions of the ring comprise a male part and a female part which releasably fit into each other and hold therebetween the ends of the blades of the toy windmill.

The present invention will now be described with reference to the accompanying drawings, in which.

Figure 1:
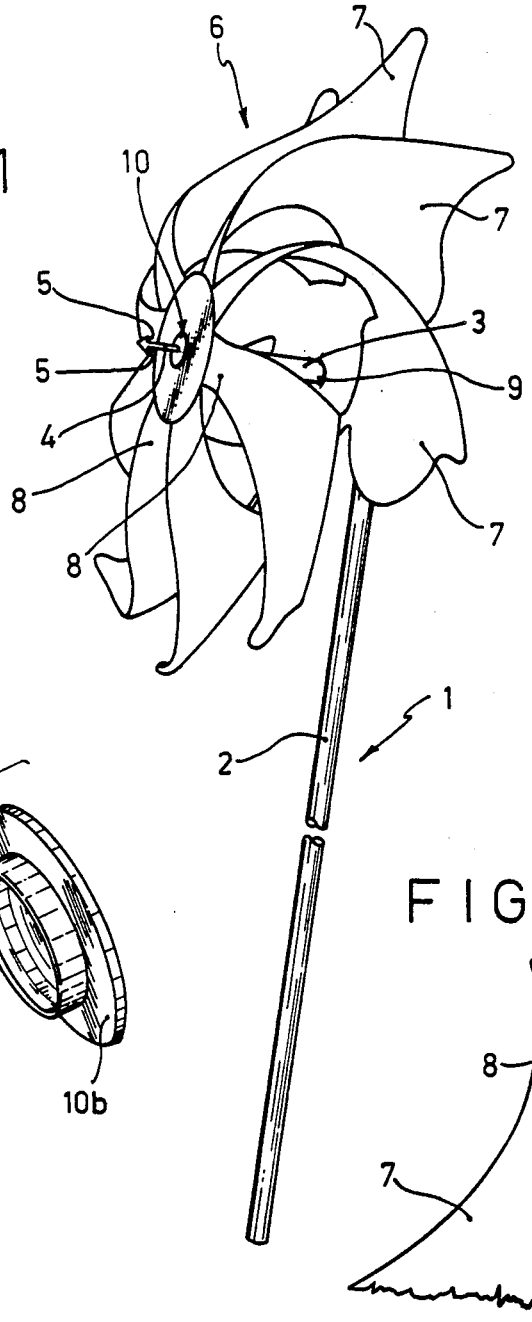
FIG. 1 is a perspective view of a mounted toy windmill provided with a mounting system in accordance with the invention.

As can be seen from the accompanying drawings, particularly FIG. 1, a toy windmill 1 is shown consisting of a stick or handle 2, a shaft 3 having an end 4 provided with two retaining barbs 5, and a propeller 6 comprising a plurality of blades 7, each provided with a corresponding free end 8. Propeller 6 of the windmill is provided with a central orifice 9, through which shaft 3 extends, and the ends 8 of blades 7 have corresponding orifices (not shown) in such a way that the blades may be doubled over themselves with their orifices superimposed so that the end 4 of the shaft may pass therethrough to provide the propeller with the final shape shown in FIG. 1.

Figure 2:
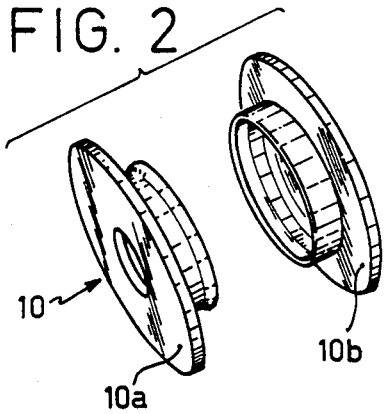
FIG. 2 is an exploded perspective view of the fixing means in accordance with a preferred embodiment of the invention.
Figure 3:
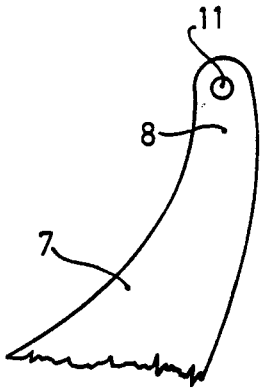
Figure 4:
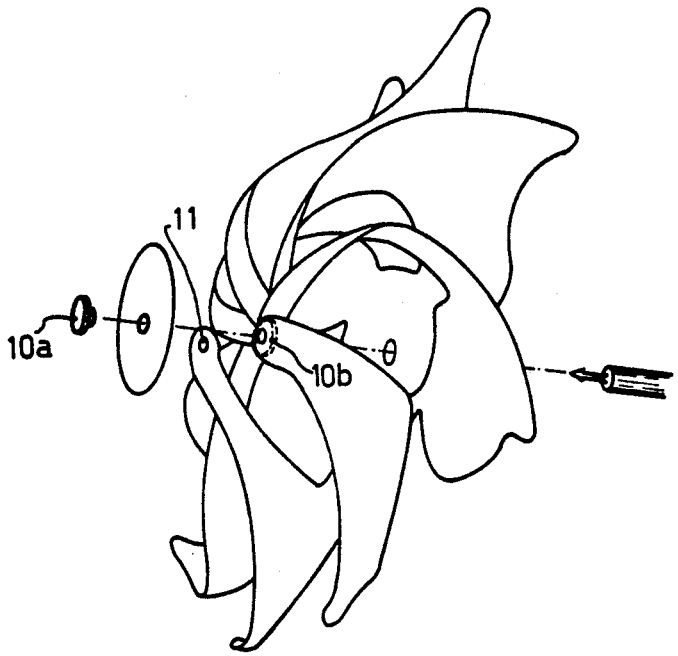

According to the preferred embodiment of the invention, one fixing means 10 is better shown in FIG. 2, consisting of a male part 10*a* and a female part 10*b* which may be fitted together releasably so that, when mounted, they sandwich the ends 8 of the blades 7 of the windmill.

As will be understood, the retaining barbs 5 serve to prevent axial sliding of the ends 8 of blades 7 which are sandwiched between the male and female parts 10*a* and 10*b* of the fixing means 10.

Consequently, the toy windmill is easily mounted and dismounted by anyone without the necessity to use any special tool which permits stocking flat in large quantities without occupying unnecessary storage space.

It should be understood that only one preferred embodiment of the invention has been described, many others being possible within the basic concept thereof. The invention should, therefore, be limited only by the terms of the following claims.

I claim:

1. Toy windmill comprising:

a fixed shaft;

at least one sheet of material having a central orifice for receiving said shaft and being cut to define a plurality of blades having ends, each of said ends having a mounting orifice; and a fixing means for supporting said ends for rotation about said fixed shaft, said fixing means comprising snap-fitting male and female parts, said male part comprising a generally planar first base portion having a central orifice for receiving said shaft and a first cylindrical sleeve portion upstanding from said first base portion around said first central orifice, said female part comprising a second substantially planar base portion with a second central orifice for receiving said shaft and a second sleeve portion around said second central orifice, said second sleeve portion press-fittingly receiving said first sleeve portion and said first and second planar base portions retaining said blade ends therebetween.

* * * * *